US007267049B2

(12) United States Patent
Babbini

(10) Patent No.: US 7,267,049 B2
(45) Date of Patent: Sep. 11, 2007

(54) SCREW PRESS FOR PRESSING FIBROUS MATERIAL, IN PARTICULAR SUGAR BEET PULP

(75) Inventor: Lionello Morando Babbini, Galeata (IT)

(73) Assignee: New Pressing Technology di Babbini Maria Teresa e C.S.R.L., Forlimpopoli (Forli'Cesena) (IT)

( * ) Notice: Subject to any disclaimer, the term of this patent is extended or adjusted under 35 U.S.C. 154(b) by 0 days.

(21) Appl. No.: 10/570,592

(22) PCT Filed: Aug. 3, 2004

(86) PCT No.: PCT/EP2004/008718

§ 371 (c)(1),
(2), (4) Date: Mar. 6, 2006

(87) PCT Pub. No.: WO2005/025846

PCT Pub. Date: Mar. 24, 2005

(65) Prior Publication Data

US 2006/0288884 A1 Dec. 28, 2006

(30) Foreign Application Priority Data

Sep. 12, 2003 (IT) ..... RE2003A0079

(51) Int. Cl.
*B30B 9/16* (2006.01)
*B30B 9/26* (2006.01)

(52) U.S. Cl. ..... 100/117; 100/128; 100/146

(58) Field of Classification Search ..... 100/117, 100/126, 127, 128, 129, 131, 145, 146, 147, 100/149, 150, 338; 210/413, 414, 415
See application file for complete search history.

(56) References Cited

U.S. PATENT DOCUMENTS

| | | | | |
|---|---|---|---|---|
| 3,019,484 A | | 2/1962 | Strohmeier | |
| 4,150,617 A | * | 4/1979 | Schramm et al. | 100/117 |
| 4,565,124 A | * | 1/1986 | Stautland et al. | 100/117 |
| 5,743,178 A | * | 4/1998 | Babbini | 100/127 |

FOREIGN PATENT DOCUMENTS

| | | |
|---|---|---|
| EP | 0 358 837 A | 3/1990 |
| FR | 1 263 433 A | 6/1981 |
| FR | 2 472 970 A | 7/1981 |

* cited by examiner

*Primary Examiner*—Jimmy Nguyen
(74) *Attorney, Agent, or Firm*—Browdy and Neimark, PLLC

(57) ABSTRACT

A screw press (1) for pressing fibrous material, in particular sugar beet pulp, comprising: at least one pair of helical elements (30) which are disposed mutually parallel and side by side and comprise at least one helix (32, 33) disposed about a rotary shaft which extends along a predetermined axial direction; a perforated walled filtering cage (5) supported by equidistant hoops (13, 14) and enclosing the helical elements (30) as an exact fit; a loading hopper (8); a discharge opening (9) for the exit of the pressed material; a collection sump (10) positioned externally to the filtering cage (4); in which the filtering cage (5) presents a modular structure having a distance between the axes of each module (M) which is constant and is a sub-multiple of, or equal to, the dimension of the loading hopper (8) measured along the predetermined axial direction, the loading hopper (8) being shiftable by its replacing one or more modules (M) of the filtering cage (5).

7 Claims, 7 Drawing Sheets

SCREW PRESS FOR PRESSING FIBROUS MATERIAL, IN PARTICULAR SUGAR BEET PULP

TECHNICAL FIELD

The present invention relates to a screw press for pressing fibrous material, in particular sugar beet pulp.

Presses of this type are generally used for squeezing out the liquid contained in fibrous materials, such as sugar beet pulp.

In the present invention the term "fibrous material" means any material having a ligneous (fibrous) component and a liquid component, and able to be pressed to separate the liquid component from the ligneous component.

PRIOR ART

Presses are known comprising two to more helical elements which rotate parallel to each other side by side within a perforated walled filtering cage. Presses of the aforesaid type have been known in the sector for many decades.

According to the said known art the material to be pressed is fed radially from above to one end of the filtering cage through a loading hopper. The material fed in this manner is pressed by the screw, rotated by suitable drive means, and urged during pressing towards that end distant from the feed end, from which it leaves, totally or at least partially dewatered, through a discharge opening.

During the advancement of the material through the press, the liquid component present in the fibrous starting material traverses the perforated wall of the filtering cage. This liquid component is collected in a sump positioned outside the cage and is conveyed towards an exit opening. Dewatering of the fibrous material is achieved by the pressure generated by forces to which the material is subjected during the pressing. This pressure, which enables the liquid component of the fibrous material to emerge through the filtering cage, depends on the particular geometry of the press, and the smallness of the gap present between the crest of the screws and the filtering cage.

In conventional presses the length of the screw, other parameters remaining equal, is chosen on the basis of the required degree of pressing of the fibrous material to be pressed, and the quantity of the ligneous component present in the feed material.

Consequently, if complete dewatering of a material of low ligneous component and hence high liquid component is required, the screw must be of considerable length to ensure that the liquid component has been completely extracted on termination of pressing.

In contrast, to obtain complete dewatering of a material of high ligneous component and hence low liquid component, the screw length must be suitably chosen to prevent the material remaining for an unnecessarily lengthy time in the press, as would happen in the case of very long screws, with a consequent increase in energy consumption and in the mechanical stress to which the press screws are subjected. The liquid component quantity in sugar beet pulp is also determined by the quantity of water absorbed during growth.

It is nearly always the rain falling on the crop which determines the liquid component quantity in the harvested beet.

Consequently, to obtain complete dewatering of sugar beet pulp the press should be optimally dimensioned on the basis of the ligneous and liquid components present in the material fed to the press.

Although complete dewatering of a high ligneous component material can be achieved using a press with screws having a length dimensioned for complete dewatering of a material of lower ligneous component, the use of such a press would be costly because complete dewatering of the (high ligneous) material is achieved long before it reaches the discharge opening.

It is well known however that a press with the optimal screw length for any required degree of dewatering does not exist.

There is therefore a strongly felt requirement for a screw press the geometry of which is independent of the desired degree of pressing and of the quantity of the ligneous component present in the feed material, and which can be easily adapted to the type of material to be fed, so avoiding sudden deterioration of the press if over-dimensioned.

DISCLOSURE OF THE INVENTION

The object of the present invention is to provide a screw press for pressing fibrous material, in particular sugar beet pulp, having structural and functional characteristics such as to satisfy the aforesaid requirements while at the same time obviating the stated drawbacks of the known art. This object is attained by a screw press for pressing fibrous material in accordance with claim 1.

The dependent claims define particularly advantageous preferred embodiments of the press according to the invention.

BRIEF DESCRIPTION OF THE DRAWINGS

Further characteristics and advantages of the invention will be apparent on reading the ensuing description provided by way of non-limiting example, with the aid of the figures illustrated in the accompanying drawings, in which.

MODES OF IMPLEMENTING THE INVENTION

Figure 1:
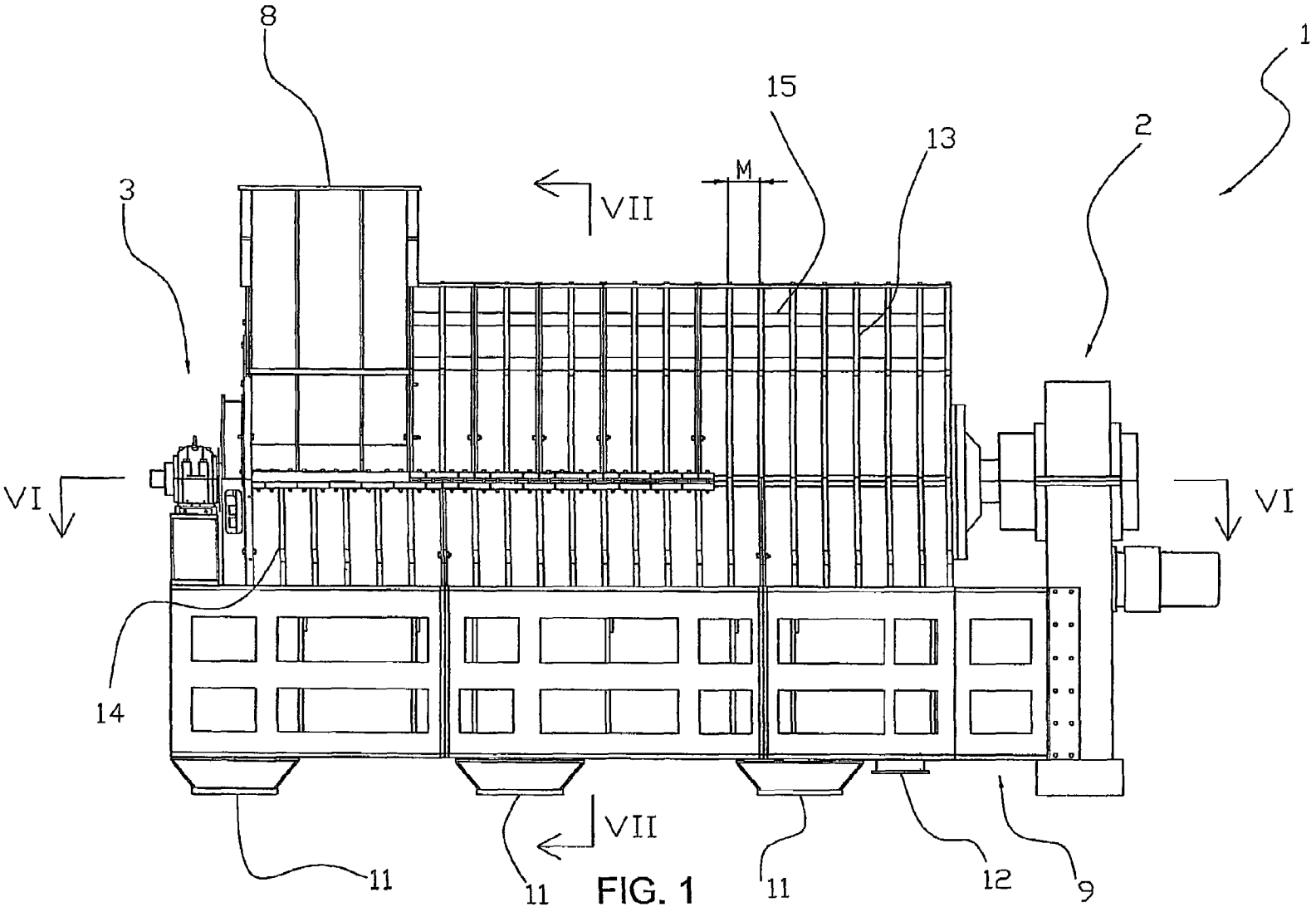
FIG. 1 is a side view of a screw press, in a possible operative configuration.

With reference to the accompanying figures, the reference numeral 1 indicates overall a screw press for pressing fibrous material, in particular sugar beet pulp.

In the illustrated examples, the press 1 comprises a pair of helical elements 20, 30 (FIGS. 3, 6), commonly called screws and also known as Archimedes screws, disposed side by side parallel to each other. Each of said helical elements 20, 30 comprises a shaft 21, 31 of cylindrical shape with their axes extending along predetermined directions X-X, X'-X' respectively.

Two helixes 22 and 23, 32 and 33 extend about each shaft 21, 31. The helixes 22, 23 (or 32, 33) of a helical element 20 (or 30) are radially offset from the helixes 32, 33 (or 22, 23) of the adjacent helical element 30 (or 20). Moreover in the illustrated example, each helix 22, 23, 32, 33 has a constant height such as to graze the surface of the adjacent shaft 31 (or 21).

Helical elements having a single helix or three or more helixes wound about each shaft can evidently be used, as known in the sector. The shafts 21, 31 are rotatably supported at their respective ends by two robust supports 2 and 3, one of which, indicated in the figures by 2, comprises internally installed drive and transmission means, preferably electrical, not shown, said means being arranged to rotate the shafts 21, 31 at the same speed but in the opposite direction.

Around the helical elements 20, 30 there is disposed a perforated walled filtering cage 5 which follows the external profile of the pair of helical elements 20, 30.

Figure 7:
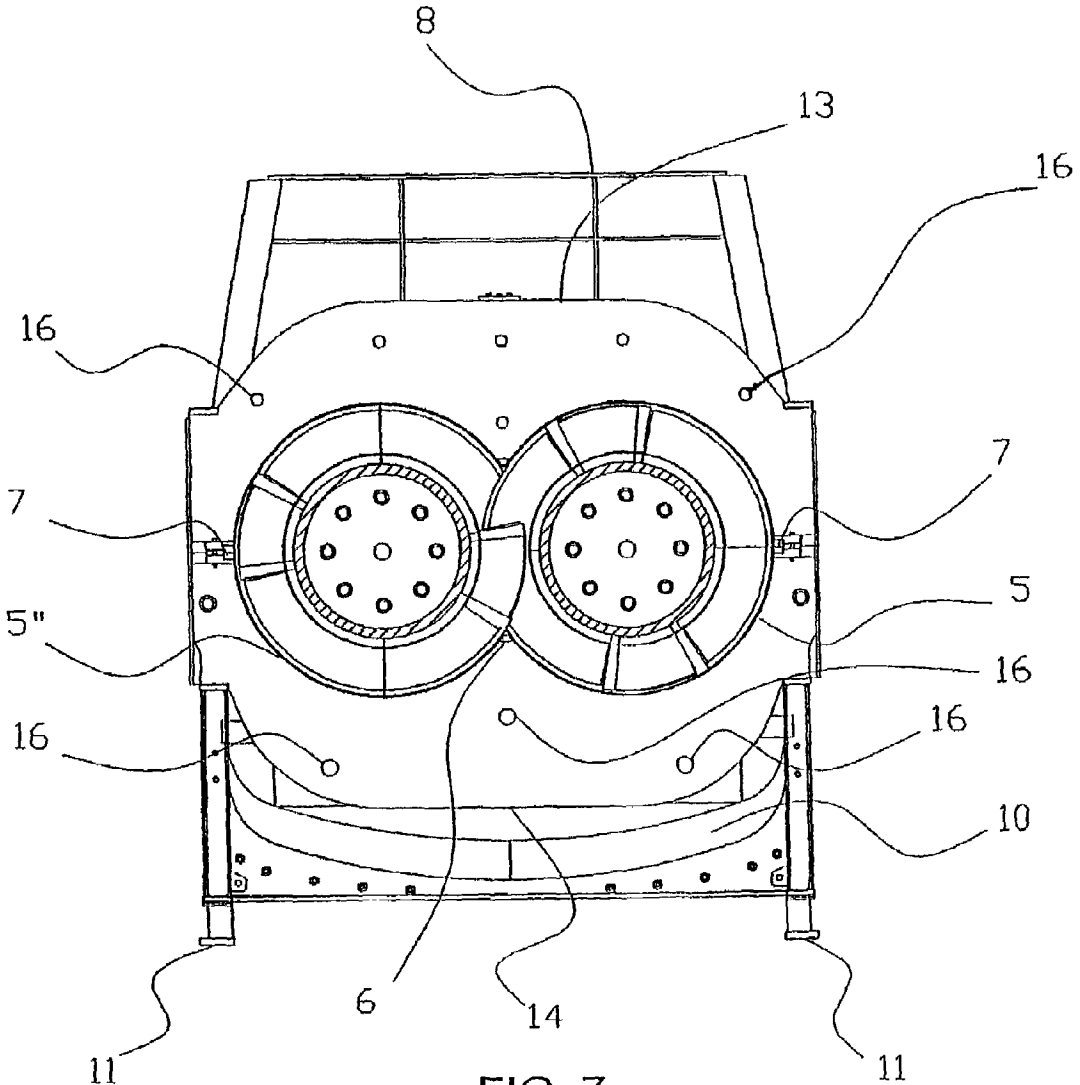
FIG. 7 is a section on the line VII-VII of FIG. 1.

The cage 5 encloses as an exact fit said pair of helical elements 20, 30, which are hence enveloped by the cage 5. Preferably, said cage 5 comprises two intersecting cylindrical portions 5' and 5" supported by suitable central rods 6 and lateral rods 7 Essentially, the two cylindrical portions 5' and 5" assume a transverse shape substantially of extended "8" form, as is visible in FIG. 7.

The filtering cage 5 comprises on the outer part of the perforated wall a plurality of upper hoops 13 and lower hoops 14 to oppose the pressure exerted by the fibrous material on said cage 5 during pressing.

These hoops 13, 14 are provided with holes 16 traversed by suitable tie rods 15 to ensure their consistency.

At that end of the press close to the support 3 (FIGS. 1, 2 and 3), the press 1 is provided with a loading hopper 8 for feeding the material to be pressed, at which the cage 5 is interrupted.

At the opposite end to the support 3, in proximity to the support 2 containing the drive and transmission means, a discharge opening 9 is provided for exit of the pressed fibrous material, this latter being generally in the form of a compacted solid body.

In accordance with an illustrated embodiment, the helixes 22, 23 and 32, 33 have a variable pitch which decreases progressively from the feed end 8 to the discharge opening 9.

Figure 6:
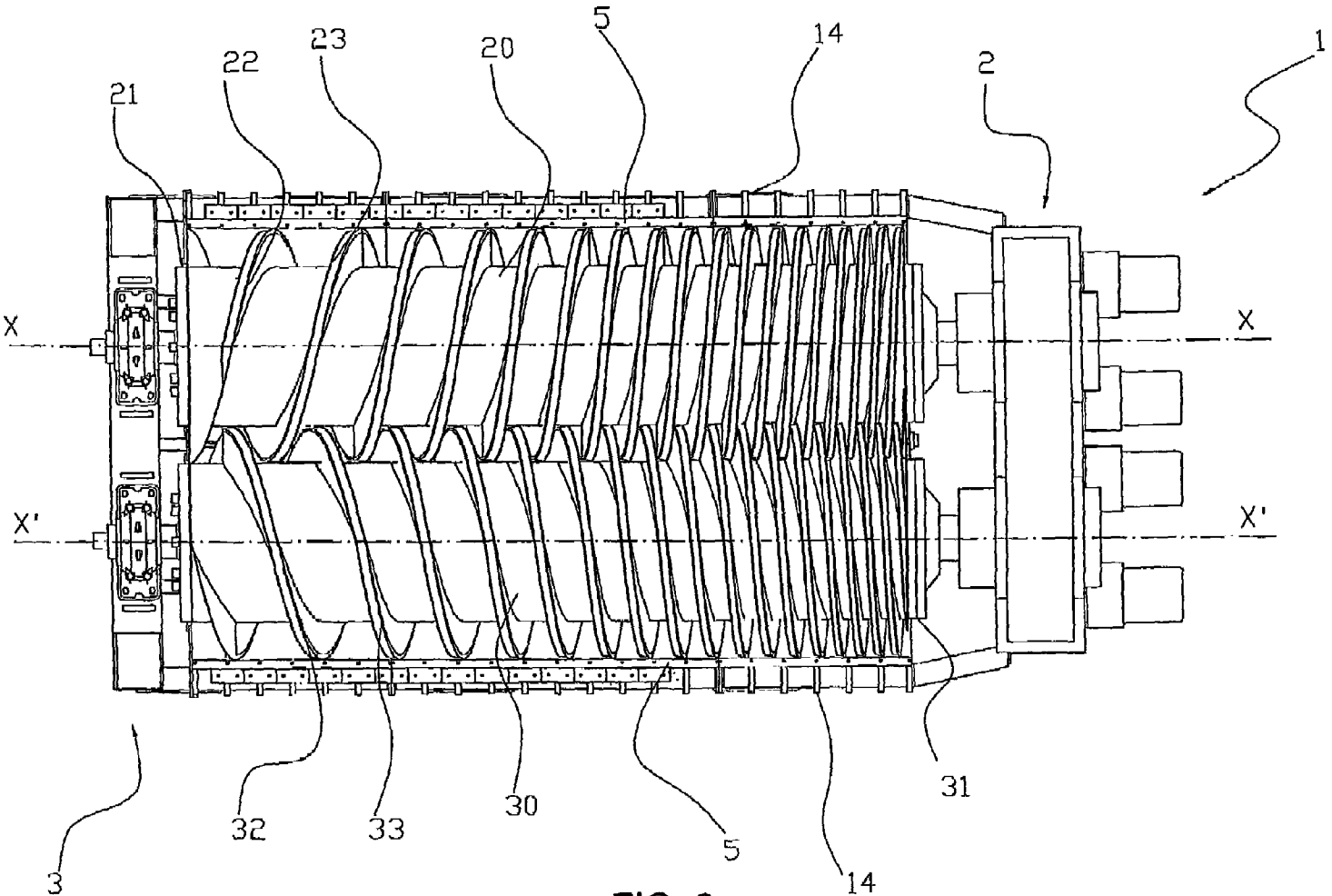
FIG. 6 is a section on the line VI-VI of FIG. 1.

Preferably, as shown in FIG. 6, the helix 22 (or 32) winds about the shaft, passing along the centre line of the pitch of the helix 23 (or 33) wound on the same shaft 21 (or 31) and vice versa.

Around the filtering cage 5 there is provided a collection sump 10 for collecting the liquid component of the pressed material. This sump 10 is supported by suitable support feet 11 which, together with the lower part of the support 2 containing the drive and transmission means, support the entire press 1.

The collection sump 10 collects in its interior the liquid component of the fibrous material fed to the press 1 and passing through the filtering cage 5, this liquid component being conveyed towards an exit opening 12 by virtue of a slight slope.

According to the invention, the filtering cage 5 is constructed with a modular structure having between the axes of each module M a constant distance equal to the axial extension of the loading hopper 8 or a sub-multiple thereof.

The loading hopper 8 is removably fixed to two or more hoops 13 in such a manner as to occupy one or more modules M of the filtering cage 5. In the example described hereinafter and as shown in the accompanying figures, the hopper 8 measures the equivalent of five modules M. Consequently, in addition to being able to be located at one end of the filtering cage 5 (FIGS. 1, 2 and 3), as in presses of the known art, the loading hopper 8 can also be advantageously shifted into a more advanced position, i.e. more central within the cage 5, as shown in FIGS. 4 and 5.

As the loading hopper 8 measures five modules M, this is achieved in practice by merely replacing five consecutive modules M of the filtering cage 5 by the hopper 8.

In addition, only those modules M pertaining to the upper half of the modular filtering cage 5 need be replaced, consequently moving only the upper hoops 13 involved.

The hopper 8 is then fixed by known fixing means to its neighbouring upper hoops 13.

According to a possible variant, two or more modules can be pre-assembled, so making it quicker and easier to shift the module. In the illustrated example, if modules M pre-assembled into groups of two or three modules are present, the shiftable hopper measuring five modules M can more quickly replace a two-module group and an adjacent three-module group.

Figure 2:
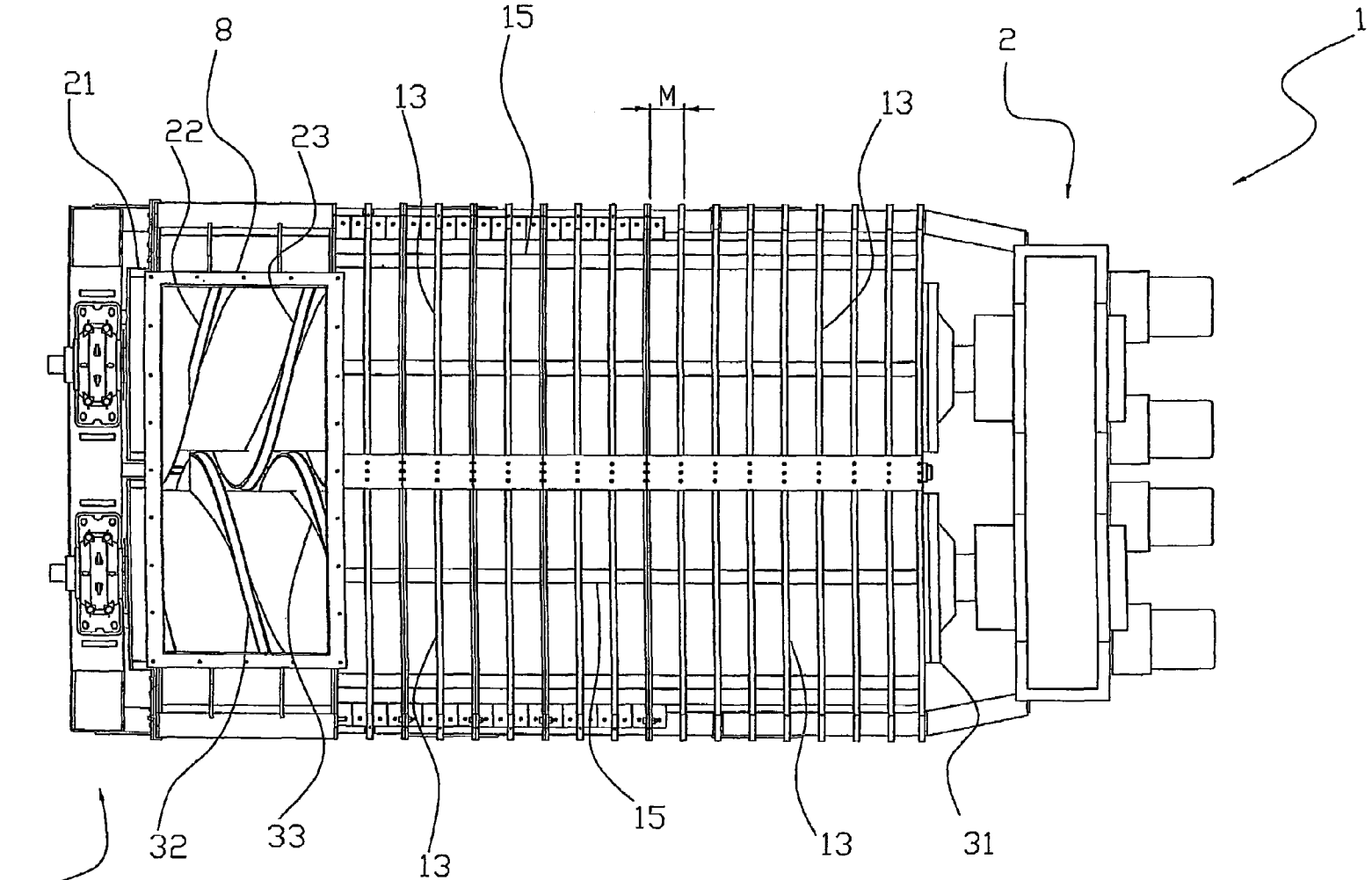
FIG. 2 is a view from above of the press of FIG. 1.
Figure 3:
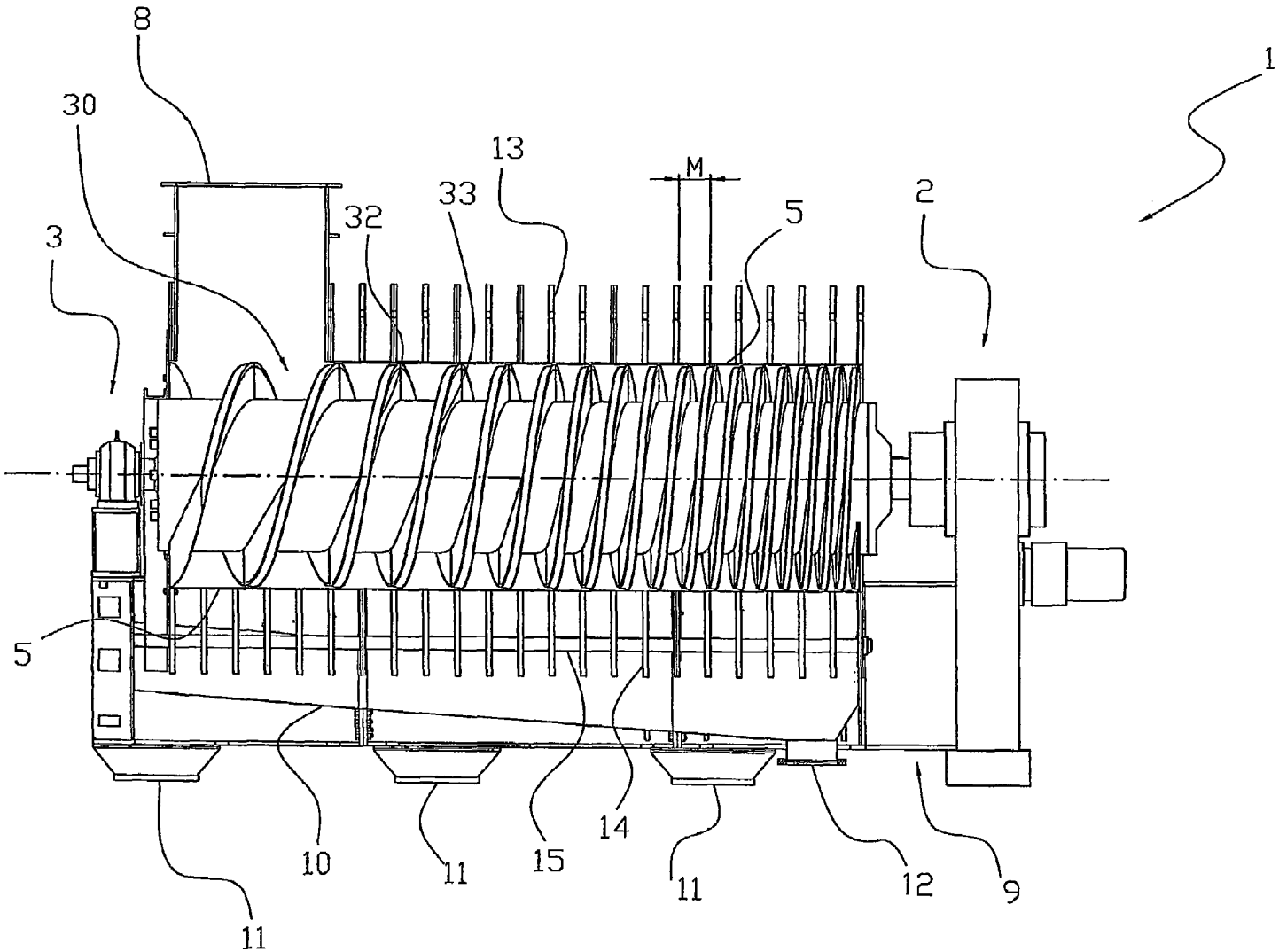
FIG. 3 is a partly sectional side view of the press of FIG. 1.
Figure 4:
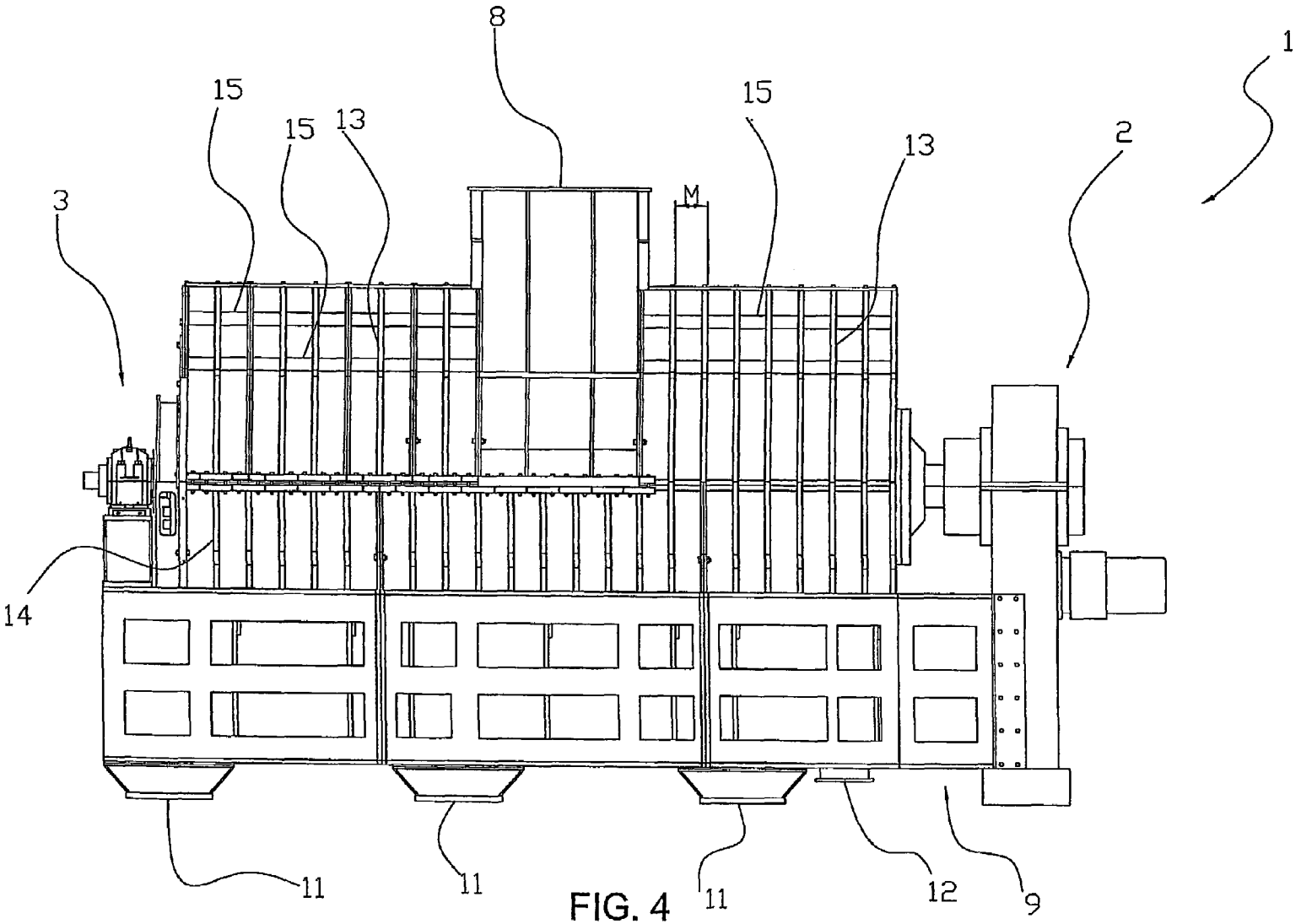
FIG. 4 is a side view of the press of FIG. 1, in a different operative configuration.
Figure 5:
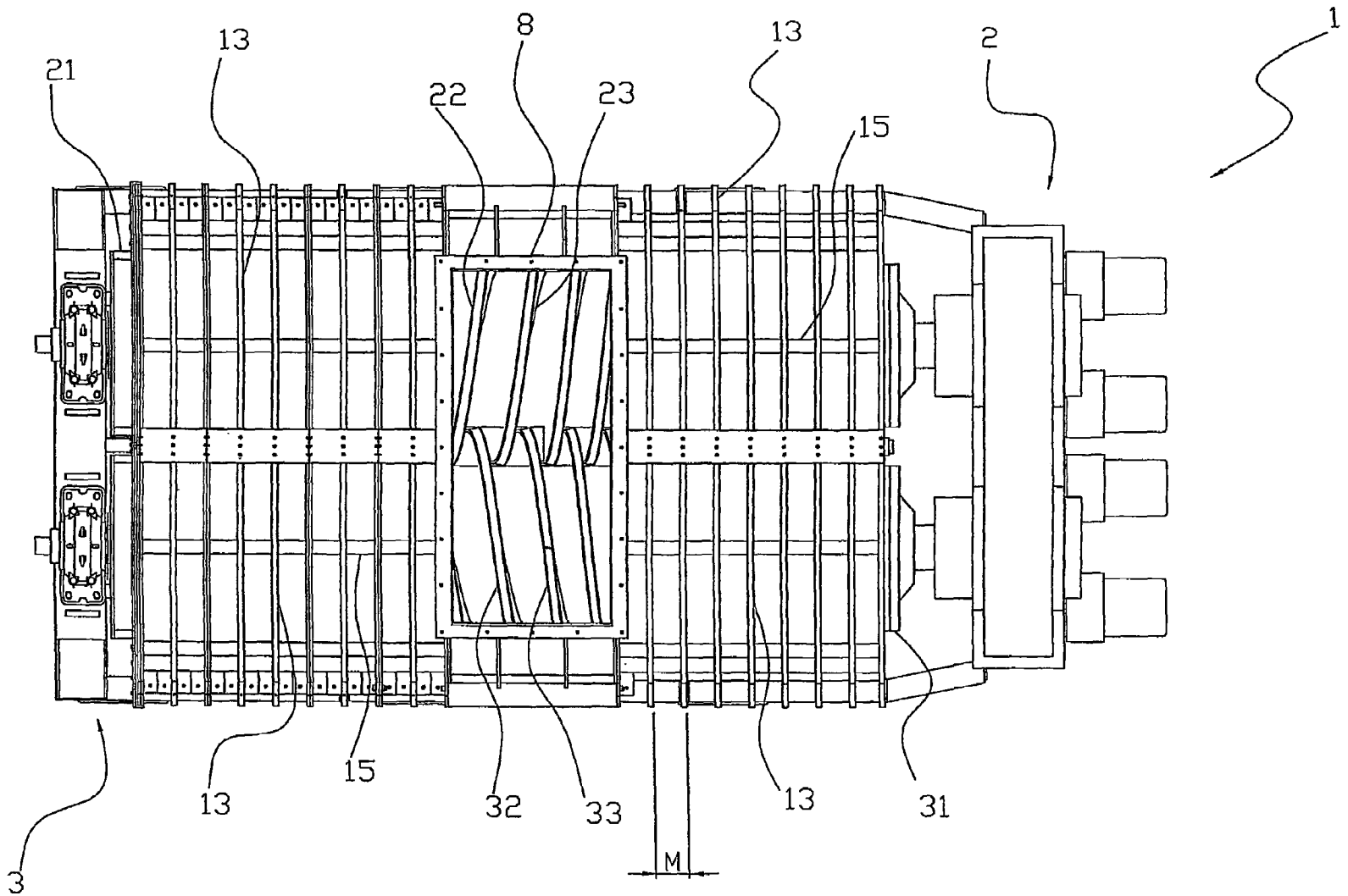
FIG. 5 is a view from above of the press illustrated in FIG. 4.

In this manner, if the hopper 8 is located in an advanced position (closest to the discharge opening 9), as shown in FIGS. 4 and 5, a press 1 is obtained in which the useful length of the helical elements 20, 30 for pressing the material is reduced compared with the configuration of FIGS. 1, 2 and 3. In this case, that part of the helical elements 20, 30 upstream of the hopper 8 is not involved in the pressing process. It should be noted that, considering the particular embodiment of the filtering cage 5 and hopper 8, the same press 1 can be used to press both fibrous material with a high ligneous component and material with a low ligneous component for the same required level of dewatering, while at the same time optimising the time (passage time) for which the material remains in the press 1.

In this respect, as the useful part of the press 1, i.e. that involved in the pressing, can be reduced on the basis of the ligneous component of the starting material, a more rational and efficient use of the press is achieved.

The hopper 8 can also be advantageously shifted on the basis of the required level of dewatering of the fibrous material to be pressed.

As will be apparent from the aforegoing description, the screw press for pressing fibrous material, in particular sugar beet pulp, according to the present invention, enables the said requirements to be satisfied and the drawbacks stated in the introduction to the present description with reference to the known art to be overcome.

Numerous variations and modifications, all contained within the scope of protection of the invention as defined in the following claims, can be made to the aforedescribed press by an expert of the art to satisfy contingent and specific requirements.

The invention claimed is:

1. A screw press (1) for pressing fibrous material or sugar beet pulp, comprising:

a feeding end and a discharge end, said fibrous material being urged during pressing according to a material advancement direction from said feeding end to said discharge end;

at least one pair of helical elements (20, 30) disposed mutually parallel and side by side, each of said helical elements (20, 30) comprising at least one helix (22, 23, 32, 33) disposed about a rotary shaft (21, 31) which extends along a predetermined axial direction (X-X, X'-X');

a perforated walled filtering cage (5) supported by a series of equidistant hoops (13, 14) and enclosing said pair of helical elements (20, 30) as an exact fit;

for feeding the fibrous material to the press, a loading hopper (8) fixed to the hoops (13, 14) supporting the cage (5);

for exit of the pressed fibrous material, a discharge opening (9) positioned in proximity to said discharge end of the press (1) with respect to said material advancement direction;

a collection sump (10) positioned externally to said filtering cage (5), to collect a liquid component of the pressed fibrous material;

characterised in that said filtering cage (5) having an upper part and a lower part, said upper part is supported by upper hoops of said series of equidistant hoops and said lower part is supported by lower hoops of said series of equidistant hoops (13, 14), the upper part being of modular structure having a plurality of modules, a distance between axes of each module (M) of said plurality of modules is constant and is a sub-multiple of, or equal to, a dimension of the loading hopper (8) measured along said predetermined axial direction, each of said plurality of modules (M) comprising at least two of said upper hoops (13), said loading hopper (8) being shiftable to a place that was occupied by one or more of said plurality of modules (M) in which one or more of the modules replaced a place that was occupied by the loading hopper before it was shifted.

2. A press (1) as claimed in claim 1, wherein said module (M) measures one fifth of the dimension of the loading hopper (8) measured along said predetermined axial direction (X-X, X'-X').

3. A press (1) as claimed in claim 1, wherein said collection sump (10) having an opening (12) for exit of the liquid component of the pressed fibrous material.

4. A press (1) as claimed in claim 1, wherein said hoops (13) are positioned a distance apart equal to a measurement of said module (M).

5. A press (1) as claimed in claim 1, wherein said helix (22, 32) winds about said corresponding rotary shaft.

6. A press (1) as claimed claim 5, wherein each of the helical elements (20, 30) having three or more helixes wind about said corresponding rotary shaft.

7. A press (1) as claimed in claim 6, wherein each of said helixes (22, 23, 32, 33) presents a pitch which decreases in the direction in which the material advances during pressing.

* * * * *